US010578013B2

(12) United States Patent
Morelli et al.

(10) Patent No.: US 10,578,013 B2
(45) Date of Patent: Mar. 3, 2020

(54) BENDABLE HEAT SHIELD FOR SIMPLIFIED SERVICING OF INTERNAL COMBUSTION ENGINE

(71) Applicant: Ford Global Technologies, LLC, Dearborn, MI (US)

(72) Inventors: Anthony Morelli, Troy, MI (US); Robert Andrew Wade, Plymouth, MI (US); Zhaokai Ma, Upminister (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/162,008

(22) Filed: May 23, 2016

(65) Prior Publication Data

US 2017/0335764 A1 Nov. 23, 2017

(51) Int. Cl.
*F02B 77/11* (2006.01)

(52) U.S. Cl.
CPC ..... *F02B 77/11* (2013.01)

(58) Field of Classification Search
CPC ..... F02B 77/11
See application file for complete search history.

(56) References Cited

U.S. PATENT DOCUMENTS 4,955,193 A * 9/1990 Hoeptner, III ..... B60K 13/04 180/225
5,180,279 A * 1/1993 McLane-Goetz ..... F01P 5/04 165/135
5,323,869 A * 6/1994 Kurayoshi ..... B62J 15/02 180/219
5,806,899 A 9/1998 Norikawa et al.
5,939,212 A * 8/1999 Ragland ..... B21D 13/00 428/594
7,216,622 B2 * 5/2007 Marks ..... B60R 13/0869 123/143 C
2004/0021352 A1 * 2/2004 Montone ..... B62J 1/12 297/219.11
2007/0191755 A1 * 8/2007 Sellis ..... B60R 16/0222 604/15
2007/0204945 A1 9/2007 Ross
2009/0071632 A1 * 3/2009 Bryant ..... F28D 15/0241 165/104.26

(Continued)

FOREIGN PATENT DOCUMENTS

EP 1674685 A1 * 6/2006 ..... F01N 13/1816

*Primary Examiner* — Joseph J Dallo
*Assistant Examiner* — Kurt Philip Liethen

(57) ABSTRACT

The disclosed inventive concept allows an underlying component requiring servicing to be serviced without removing the heat shield entirely. The heat shield has two ends and an intermediate bendable area that allows it to flex, thereby giving the service technician access to the underlying component when only some of the fasteners are removed. The intermediate area of the heat shield is formed from a series of parallel and alternating ridges and grooves. The intermediate area of the heat shield is nominally flat and straight while the bellows are formed in the straight area by a process such as stamping. This combination of a flat and bellow enables the heat shield to be bent out of position and then restored to the original position after service. The heat shield may be entirely formed from a metal or the intermediate bendable area may be composed of a polymerized material such as rubber.

14 Claims, 4 Drawing Sheets

(56) References Cited

U.S. PATENT DOCUMENTS

| | | | | |
|---|---|---|---|---|
| 2009/0301415 | A1* | 12/2009 | Ogawa | F02B 75/22<br>123/54.4 |
| 2010/0102588 | A1* | 4/2010 | Li | B60J 11/02<br>296/98 |
| 2015/0338125 | A1 | 11/2015 | Bowen | |

* cited by examiner

BENDABLE HEAT SHIELD FOR SIMPLIFIED SERVICING OF INTERNAL COMBUSTION ENGINE

TECHNICAL FIELD

The disclosed inventive relates to heat shields for internal combustion engines. More particularly, the disclosed inventive concept relates to a heat shield for an internal combustion engine that can be readily moved without complete detachment from the engine thereby allowing servicing of one or more underlying components with minimal inconvenience to the service technician.

BACKGROUND OF THE INVENTION

The burning of hydrocarbon fuels in the internal combustion is an exothermic reaction that releases energy in the form of pressure, temperature, and, heat. It has been generally known for some time in the automotive industry that various components within the vehicle transmit large amounts of heat which must be shielded from other heat sensitive components in the vehicle. Today's high specific power output engines operate at high exhaust gas temperatures for prolonged periods of time. These exhaust gas temperatures can sometimes be as high as 1050° C. This high exhaust gas temperature causes exhaust manifolds, turbine housings, and catalyst cans to become very hot and remain hot during engine operation.

Heat transfer from hot exhaust components during engine operation can degrade other under-hood components including, but not limited to, motor mount rubber, fluid tube sealing o-rings, plastic covers, and electrical insulation. The degradation of these components from heat exposure causes material property degradation which subjects the components to accelerated fatigue damage. Underhood heat transfer occurs by convection, conduction, and radiation. Exhaust components operating at their peak temperature tend to be dominated by radiation heat transfer. Radiation is a "line of sight" mechanism which can be reduced with reflective shielding. It is thus desirable to prevent the transfer of the radiation by shielding heat sensitive components.

To protect components from this heat, the hot exhaust components are often designed to include a heat shield. Modern downsized and boosted engines generate more under-hood heat than earlier natural aspirated configurations. Modern engines sometimes become very hot for a relatively brief period of time during the vehicle's operating life, such as when pulling a trailer or when ascending a steep hill during which time the vehicle engine uses a lot of fuel energy that, in turn, produces high exhaust gas temperature, heat shields have been designed to be larger to account for such operating conditions. To enhance heat protection, heat shields are typically made in three layers including high strength stainless steel which makes them relatively inflexible.

Mechanical fasteners are conventionally used to attach the heat shield to points on the engine. Typically the fasteners are bolts that fasten the heat shield to the hot component. Another common convention is to use studs strategically positioned on the engine and nuts that retain the shield. However, it is known that thermal cycling of the heat shield fasteners with plain threads can cause loosening over time. As a result, prevailing torque fasteners are commonly used to insure retention for the life of the vehicle.

In the event where the turbocharger or a surrounding component needs to be accessed in service, the heat shield may have to be entirely removed. Complete removal of the shield might also be required to service oil supply lines, oil drain lines, vacuum control tubes, vacuum control solenoids, exhaust systems, or manifolds.

However, removal of the heat shield may involve complications that present challenges to the repair technician. For example, there have been many instances in service where the prevailing torque fastener has broken and been difficult to remove when the heat shield has to be removed. In this case, a new turbocharger must be installed when only the prevailing torque fastener is broken. This can add significant cost to the repair procedure.

I For these reasons, it would be advantageous to provide an effective heat shield that can be sufficiently moved to allow access to an underlying component without the need to remove the prevailing torque fastener.

SUMMARY OF THE INVENTION

The disclosed inventive concept overcomes a problems of heat shielding according to current technology and the problems associated with servicing the vehicle. The disclosed inventive concept allows an underlying component requiring servicing to be accessed without the need to remove the heat shield entirely. The fasteners most difficult to remove, such as an interference fit fastener in the form of a prevailing torque fastener, may be left in place while the fasteners easiest to remove can be accessed. The heat shield has an intermediate bendable area that allows it to flex, thereby giving the service technician access to the underlying component when only some of the fasteners are removed.

The intermediate area of the heat shield is formed from a series of parallel and alternating ridges and grooves that define a flexible bellows. The intermediate area of the heat shield is nominally flat and straight while the bellows are formed in the straight area by a process such as stamping. This combination of a flat and bellow enables the heat shield to be bent out of position and then restored to the original position after service. Accordingly, a vehicle's turbocharger or surrounding components may serviced by removing only a single fastener or a limited number of fasteners and then bend the heat shield so that component below the heat shield can accessed.

The heat shield of the disclosed inventive concept may be formed from aluminum, steel, stainless steel, aluminized steel, galvanized steel, aluminum clad steel, or low carbon steel. It may be a single or multiple layer heat shield. The shield may have preformed topography maintained throughout the part. Alternatively, the first and second ends of the shield may be formed from aluminum, steel, stainless steel, aluminized steel, galvanized steel, aluminum clad steel, or low carbon steel while the intermediate area may be formed from a polymerized material such as rubber.

The stamped bellow is a simple and inexpensive design feature that, if designed into the total vehicle package near the beginning of a project, it can be easily incorporated into the stamping dies for heat shield formation during the manufacturing process. The straight and bellow have minimal impact on the heat shield function but does enable service. The alternative is replacing the entire turbocharger at high cost when the fastener fails and becomes lodged in the cast components of the hot exhaust system. Other alternatives having fastening schemes that do not bolt to the turbine housing result in a larger heat shield than is necessary and the associated higher cost.

The above advantages and other advantages and features will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein.

DETAILED DESCRIPTION OF THE PREFERRED EMBODIMENT

Figure 1:
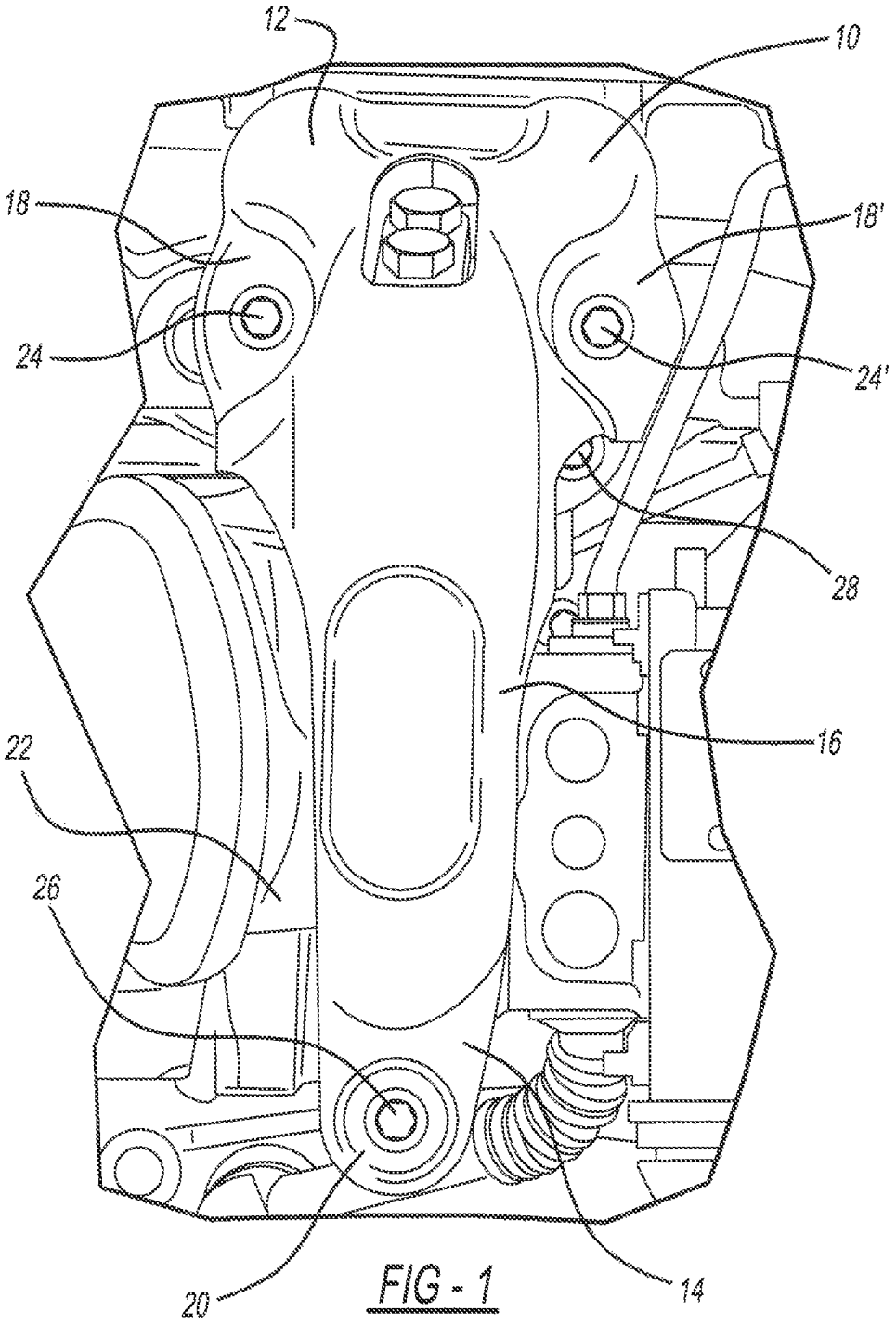
FIG - 1 Prior Art
FIG. 1 is a plan view of a heat shield for use with an internal combustion engine according to existing technology shown in position relative to the engine.

In the following figures, the same reference numerals will be used to refer to the same components. In the following description, various operating parameters and components are described for different constructed embodiments. These specific parameters and components are included as examples and are not meant to be limiting.

Figure 2:
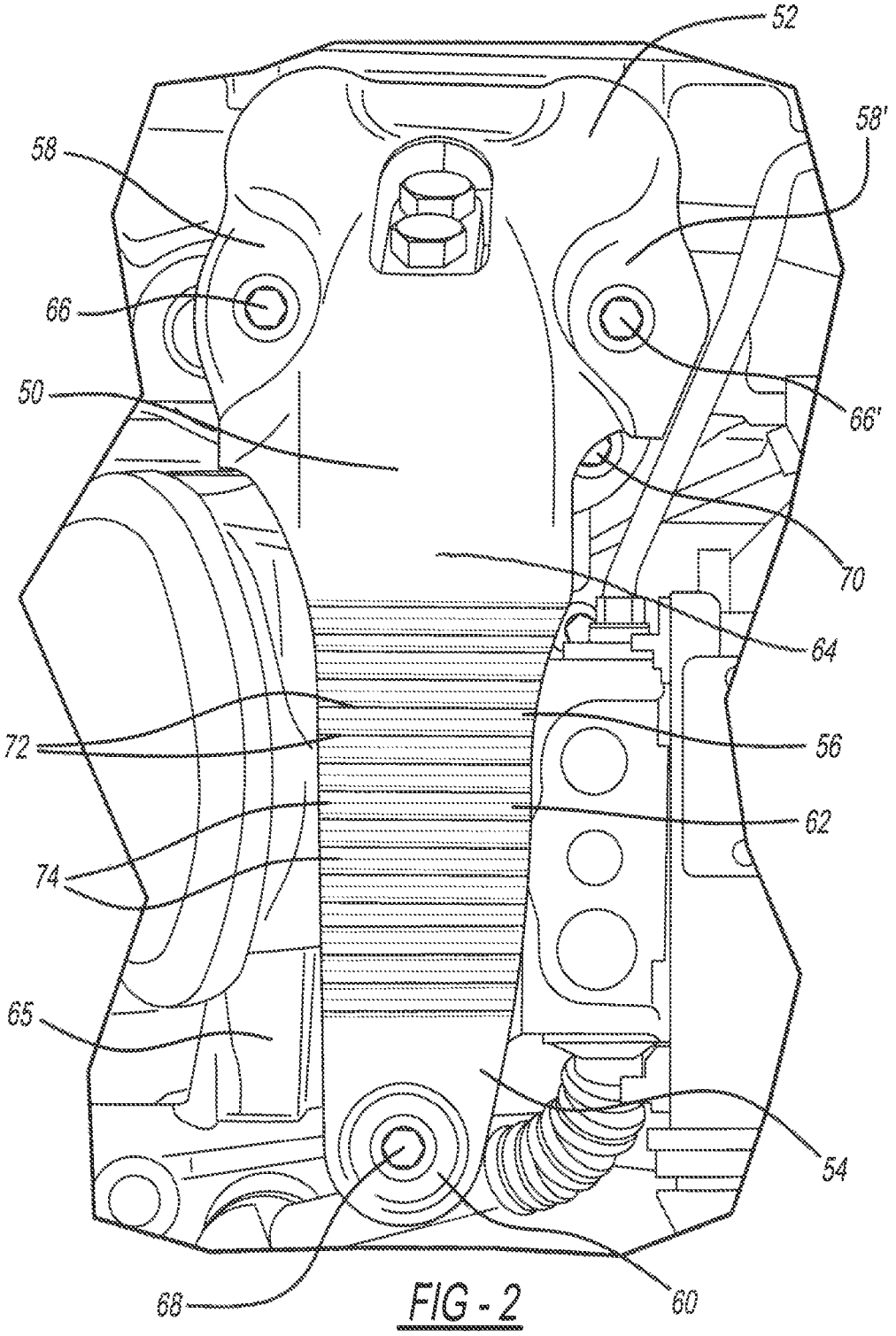
FIG. 2 is a plan view of an embodiment of a bendable heat shield for use with an internal combustion engine according to the disclosed inventive embodiment shown in position relative to the engine.
Figure 3:
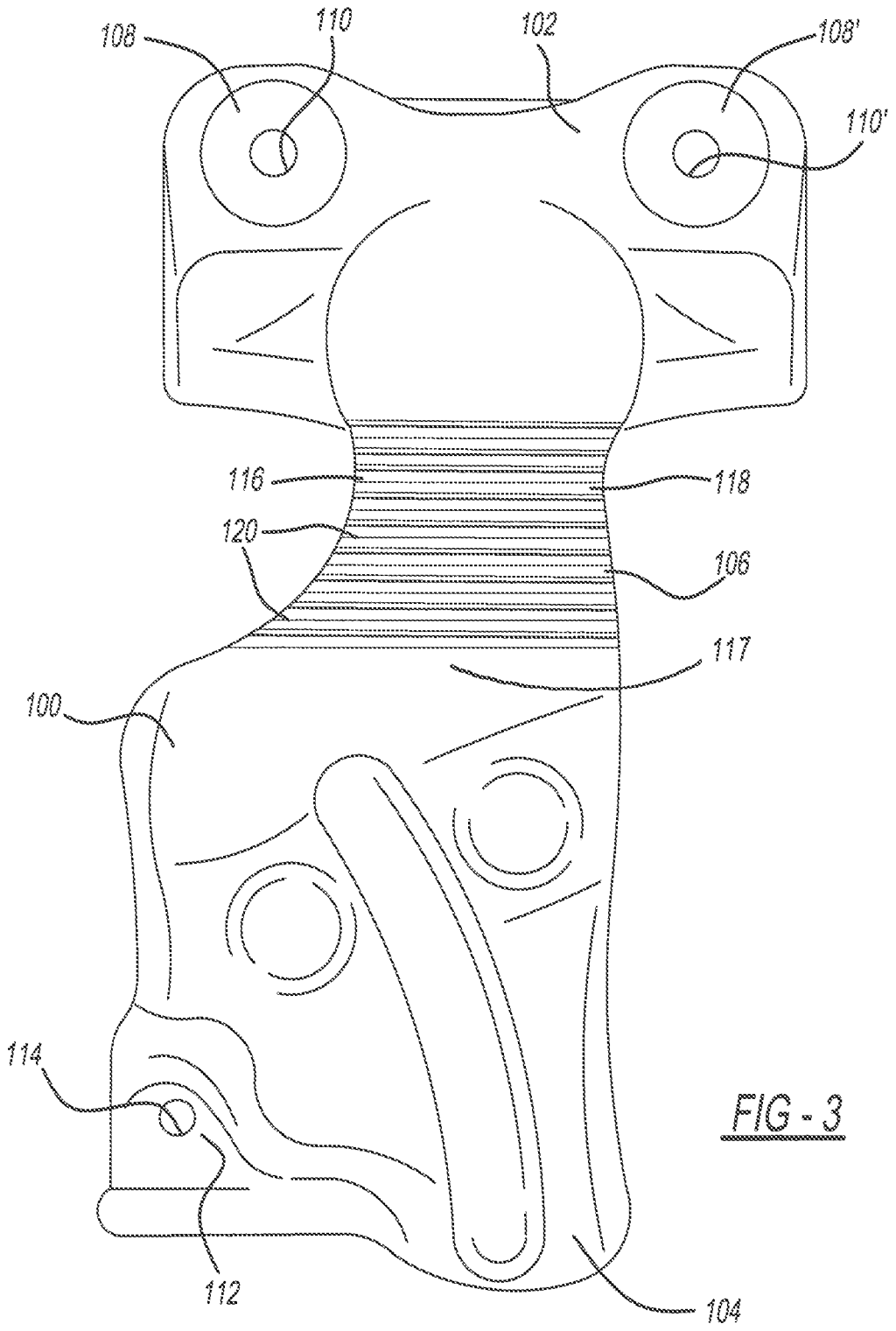
FIG. 3 is a plan view of an alternate embodiment of a bendable heat shield for use with an internal combustion engine according to the disclosed inventive embodiment shown in isolation.
Figure 4:
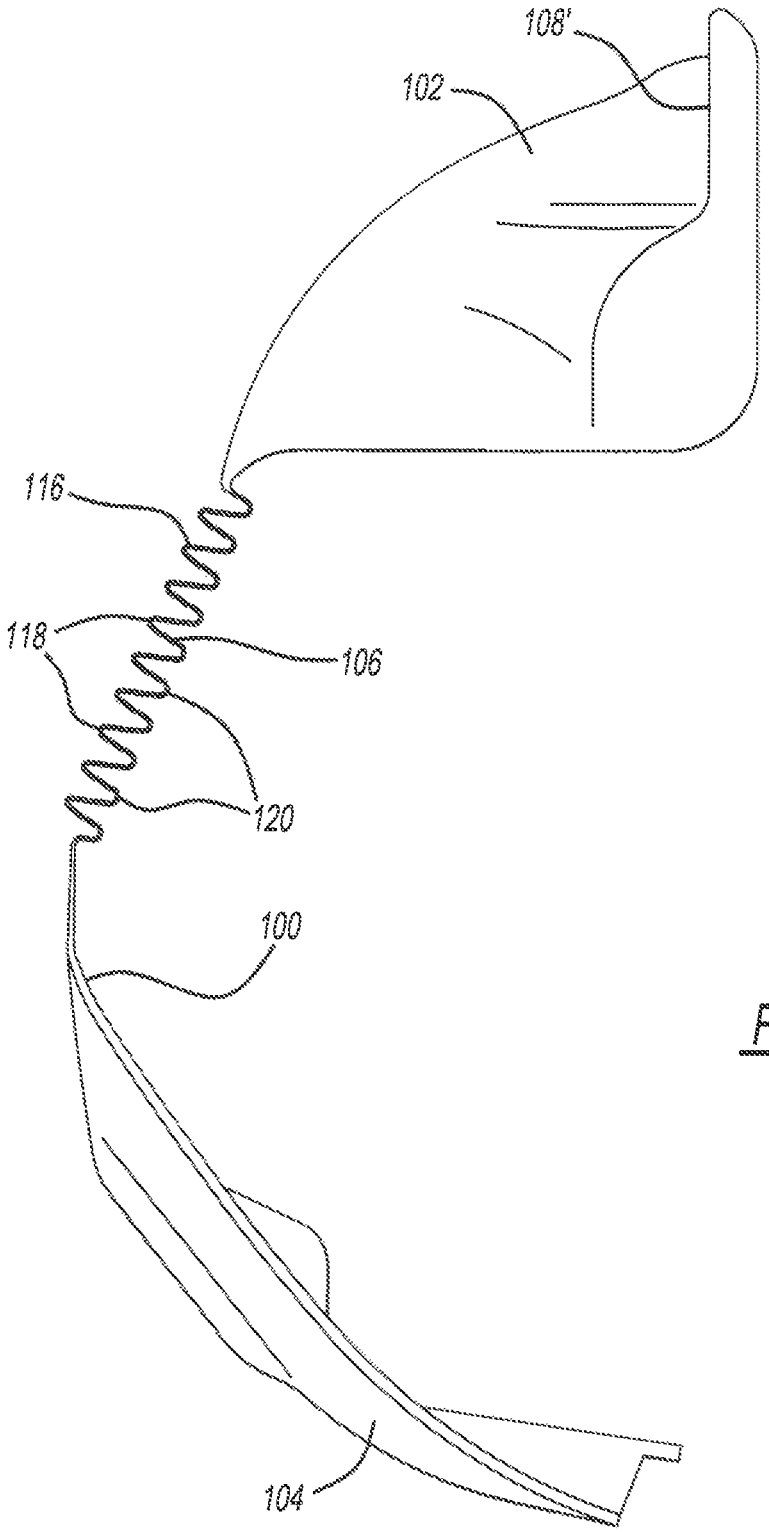
FIG. 4 illustrates a side view of the alternate embodiment of the bendable heat shield of FIG. 3.

While FIG. 1 illustrates a plan view of a known heat shield for use with an internal combustion engine, FIGS. 2-4 illustrate two embodiments of the bendable heat shield according to the disclosed inventive concept.

A plan view of a known heat shield 10 is shown in FIG. 1. The heat shield 10 includes a first end 12 and an opposed second end 14. A middle portion 16 is positioned between the first end 12 and the second end 14. Recessed fastener areas 18 and 18' are formed in the first end 12 while a recessed fastener area 20 is formed in the second end 14.

The heat shield 10 is positioned over an internal combustion engine 22. Heat shields such as the heat shield 10 are conventionally positioned on the internal combustion engine 22 in a variety of positions. The heat shield 10 is mechanically attached to the internal combustion engine 22 by, for example, straight thread fasteners 24 and 24' that are easy to remove. The straight thread fasteners 24 and 24' are provided in the recessed fastener areas 18 and 18' formed in the first end 12. The heat shield 10 is also mechanically attached to the internal combustion engine 22 by a prevailing torque fastener 26 that is more difficult to remove without damage. The prevailing torque fastener 26 is provided in the recessed fastener area 20. Other installations of similar shield may use more fasteners and may be exclusively prevailing torque fasteners.

The known heat shield 10 is formed from a rigid and inflexible material such as steel. In the event that, for example, engine service is required that involves removal of a component 28 positioned between the heat shield 10 and the internal combustion engine 22, it is necessary to completely remove the heat shield 10. Because of its inherent inflexibility, access to the component 28 requiring service forces the technician to remove completely the heat shield 10. Complete removal of the heat shield 10 necessitates removal of straight thread fasteners 24 and 24' as well as the prevailing torque fastener 26. In some instances, fastener 24 and 24' may be prevailing torque nuts which would preferably not be removed. Removal of the prevailing torque fastener 26 is not only difficult but can lead to breakage.

The disclosed inventive concept is directed to an approach that allows the service technician to gain access to one or more components between the heat shield and the internal combustion engine by removing some of the heat shield fasteners while leaving others, such as the prevailing torque fastener, in place. The heat shield of the disclosed inventive concept provides a degree of flexibility that allows bending without compromising its heat shielding characteristics.

Particularly, and referring to FIG. 2, a plan view of an embodiment of a bendable heat shield 50 for use in an internal combustion engine is illustrated. It is to be understood that the overall shape and size of the bendable heat shield 50 illustrated herein is only suggestive as other shapes and sizes may be adapted for use with the bendable feature of the disclosed inventive concept. It is to be understood that while the bendable heat shield 50 is shown and described below in relation to a vehicle's engine, the bendable heat shield 50 according to the disclosed inventive concept may find application in any other area of the vehicle where heat shielding is required.

The heat shield 50 includes a first end 52 and a second end 54. Between the opposed first end 52 and second end 54 is a bendable intermediate area 56. Recessed fastener areas 58 and 58' are formed on the first end 52. A recessed fastener area 60 is formed on the second end 54. While two recessed fastener areas 58 and 58' are shown formed on the first end 52 and while one recessed fastener area 60 is shown formed on the second end 54, it is to be understood that a greater or lesser number of recessed fastener areas may be formed depending on the number of fasteners required to attach the bendable heat shield 50.

The heat shield 50 may be formed from single heat-insulating material such as aluminum, steel, stainless steel, aluminized steel, galvanized steel, aluminum clad steel, or low carbon steel. Alternatively, the first end 52 and the second end 54 of the heat shield 50 may be formed from aluminum, steel, stainless steel, aluminized steel, galvanized steel, aluminum clad steel, or low carbon steel while the bendable intermediate area 56 may be formed from a polymerized material such as rubber. The shield may be of a single layer or may multiple layers sandwiched together or with an air gap between the layers.

The bendable intermediate area 56 comprises a bellows or corrugated area 62 that is formed in a nominally flat and straight region 64, preferably by stamping. This region may be flat and bellowed in a plane while bending in the direction perpendicular to the folds of the bellows. A straight section or a preformed, bent section are possible embodiments of the bellow configuration.

The heat shield 50 is attached to an internal combustion engine 65 by a mechanical fastening arrangement that includes studs and nuts on selected locations on the internal combustion engine 65. Particularly, fasteners 66 and 66', which may be straight thread or prevailing torque, attach the first end 52 of the heat shield 50 at recessed areas 58 and 58' while a straight thread or prevailing torque fastener 68 attaches the second end 54 of the heat shield 50 at the recessed area 60. A greater or lesser number of fasteners would be different embodiments of the same concept used to attach the heat shield 50 to the internal combustion engine 65 without deviating from the spirit of the disclosed inventive concept.

The disclosed inventive concept, as noted, focuses on allowing easy servicing of an engine component by removing the fewest number of fasteners possible while still accessing the components under the shield. Particularly, and referring to the embodiment shown in FIG. 2, a primary objective of the disclosed inventive concept is to leave, for example, the prevailing torque fastener 68 in place while only the straight thread fasteners 66 and 66' need to be removed.

For example, it may be that the service technician requires access to service a component 70 associated with the engine 65. The bendable intermediate area 56 allows for sufficient bending of the heat shield 50 to thereby allow the prevailing torque fastener 68 to remain in place. The flexibility of the bendable intermediate area 56 is made possible by a series of parallel and alternating ridges 72 and grooves 74. Because of the geometric feature of the heat shield 50 that is the result of the bendable intermediate area 56 and the nominally flat and straight region 64, the heat shield 50 may be bent out of position and then restored to its original operating position after service.

An additional embodiment of the bendable heat shield of the disclosed inventive concept is illustrated in FIGS. 3 and 4 in which a bendable heat shield 100 is illustrated. As in the case of the heat shield 50 shown in FIG. 2 and discussed in conjunction therewith, the overall shape and size of the bendable heat shield 100 shown in FIGS. 3 and 4 is only suggestive as other shapes and sizes may be adapted for use with the bendable feature of the disclosed inventive concept. It is to be understood that while the bendable heat shield 100 is shown and described below in relation to a vehicle's engine, the bendable heat shield 100 according to the disclosed inventive concept may find application in any other area of the vehicle where heat shielding is required.

The heat shield 100 includes a first end 102 and a second end 104. Between the opposed first end 102 and second end 104 is a bendable intermediate area 106. Recessed fastener areas 108 and 108' are formed on the first end 102. Recessed fastener holes 110 and 110' are formed respectively in the recessed fastener areas 108 and 108'. A recessed fastener area 112 is formed in the second end 104 of the heat shield 100. A fastener hole 114 is formed in the recessed fastener area 112. A greater or lesser number of fastener holes may be formed in either or both ends of the heat shield 100.

The heat shield 100 may be formed from single heat-insulating material such as aluminum, steel, stainless steel, aluminized steel, galvanized steel, aluminum clad steel, or low carbon steel. Alternatively, the first end 102 and the second end 104 of the heat shield 100 may be formed from aluminum, steel, stainless steel, aluminized steel, galvanized steel, aluminum clad steel, or low carbon steel while the bendable intermediate area 106 may be formed from a polymerized material such as rubber. The shield may be of a single layer or may multiple layers sandwiched together or with an air gap between the layers.

The bendable intermediate area 106 comprises a bellows or corrugated area 116 that is formed in a nominally flat and straight region 117. The bellows or corrugated area is formed by a series of parallel and alternating ridges 118 and grooves 120.

Like the heat shield 50 illustrated in FIG. 2 and discussed in conjunction therewith, the heat shield 100 allows easy servicing of an engine component because of the inclusion of the bendable intermediate area 106 by permitting the service technician to remove the fewest number of fasteners possible while still accomplishing the desired task. The bendable intermediate area 106 allows for sufficient bending of the heat shield 100 to thereby allow at least one fastener, such as a prevailing torque fastener, to remain in place. Thus the heat shield 100 may be bent out of position and then restored to its original operating position after service in the same manner as the heat shield 50.

One skilled in the art will readily recognize from the above discussion, and from the accompanying drawings and claims, that various changes, modifications and variations can be made therein without departing from the true spirit and fair scope of the invention as defined by the following claims.

What is claimed is:

1. A heat shield for protecting a heat sensitive vehicle component from heat generated by a nearby heat source, the shield comprising:

a first end;

a second end;

an intermediate area, said first end, said second end, and said flexible intermediate area having a long axis, said flexible intermediate area positioned between said rigid first end and said rigid second end, said rigid first end and said rigid second end extending from opposite ends of said flexible intermediate area, said flexible intermediate area having a flexing channel perpendicular to said long axis, wherein said first end and said second end are formed from at least one layer of material selected from the group consisting of aluminum, steel, stainless steel, aluminized steel, galvanized steel, aluminum clad steel, and low carbon steel.

2. The heat shield for protecting a heat sensitive vehicle component of claim 1, wherein said flexible intermediate area includes a flat and straight region and wherein said plurality of ridges and grooves are formed in said flat and straight region.

3. The heat shield for protecting a heat sensitive vehicle component of claim 1, wherein said ridges and grooves form a bellows portion, said bellows portion being angled, said ridges and grooves being level relative to one another.

4. The heat shield for protecting a heat sensitive vehicle component of claim 1, wherein said flexible intermediate area is formed from a polymerized material.

5. An assembly for protecting a heat sensitive under-hood vehicle component from heat generated by a nearby under-hood heat source comprising:

an internal combustion engine;

a heat shield having a long axis, a rigid first end, a second rigid end, and a flexible intermediate area positioned between said rigid first end and said rigid second end, said rigid first end and said rigid second end extending from opposite ends of said flexible intermediate area, said flexible intermediate area having a flexing channel perpendicular to said long axis;

a fastener for attaching said first end to said engine; and an interference fit fastener for attaching said rigid second end to said engine.

6. The assembly for protecting a heat sensitive under-hood vehicle component of claim 5, wherein said flexing channel is a flexing groove.

7. The assembly for protecting a heat sensitive under-hood vehicle component of claim 6, wherein said flexing groove is one of a series of parallel alternating ridges and grooves.

8. The assembly for protecting a heat sensitive under-hood vehicle component of claim 7, wherein said intermediate area includes a flat and straight region and wherein said plurality of ridges and grooves is formed in conjunction with said flat region.

9. The assembly for protecting a heat sensitive under-hood vehicle component of claim 5, wherein said intermediate area is formed from a polymerized material.

10. The assembly for protecting a heat sensitive under-hood vehicle component of claim 9, wherein said polymerized material is rubber.

11. The assembly for protecting a heat sensitive under-hood vehicle component of claim 5, wherein said interference fit fastener is a prevailing torque fastener.

12. A method of servicing an under-hood component on a vehicle comprising:

forming a heat shield for protecting a heat sensitive under-hood vehicle component from heat generated by a nearby under-hood heat source in which the heat shield comprises a first rigid end having an attachment fastener attached to said under-hood component, a rigid second end having an attachment fastener attached to said under-hood component, and a bendable intermediate area formed from a series of parallel alternating ridges and grooves, said rigid first end and said rigid second end extending from opposite ends of said bendable intermediate area, said rigid first and second ends being formed from at least one layer of material selected form the group consisting of aluminum, steel, stainless steel, aluminized steel, galvanized steel, aluminum clad steel, and low carbon steel;

removing said rigid first end attachment fastener from said under-hood component while leaving said rigid second end attachment fastener in place on said under-hood component; and bending said shield at said bendable intermediate are to allow access to the under-hood component.

13. The method for servicing the under-hood component of claim 12, wherein one of said attachment fasteners is an interference fit fastener.

14. The method for servicing the under-hood component of claim 12, wherein said intermediate area includes a flat and straight region and wherein said plurality of ridges and grooves is formed in conjunction with said flat region.

* * * * *